US007331181B2

(12) United States Patent
Roppo

(10) Patent No.: US 7,331,181 B2
(45) Date of Patent: Feb. 19, 2008

(54) REHEATING STEAM TEMPERATURE CONTROL

(75) Inventor: Markku Roppo, Tampere (FI)

(73) Assignee: Metso Power Oy, Tampere (FI)

( * ) Notice: Subject to any disclaimer, the term of this patent is extended or adjusted under 35 U.S.C. 154(b) by 0 days.

(21) Appl. No.: 11/415,165

(22) Filed: May 2, 2006

(65) Prior Publication Data

US 2006/0248891 A1 Nov. 9, 2006

(30) Foreign Application Priority Data

May 4, 2005 (FI) ..... 20055208

(51) Int. Cl.
*F01K 7/34* (2006.01)

(52) U.S. Cl. ..... 60/653; 60/679

(58) Field of Classification Search ..... 60/653, 60/679, 680
See application file for complete search history.

(56) References Cited

U.S. PATENT DOCUMENTS 2,967,397 A * 1/1961 Vogler ..... 60/679
2,984,984 A * 5/1961 Dickey ..... 60/647
3,163,991 A * 1/1965 Capitaine ..... 60/646
3,277,651 A * 10/1966 Augsburger ..... 60/657
4,060,990 A * 12/1977 Guido et al. ..... 60/676
5,209,188 A 5/1993 Weitzel
5,605,118 A 2/1997 Sinn et al.
2002/0017100 A1 2/2002 Berndt et al.

FOREIGN PATENT DOCUMENTS

CH 280010 A 4/1952
CH 322433 A 7/1957
DE 1203800 B 10/1965
WO WO90/08917 A1 8/1990

* cited by examiner

*Primary Examiner*—Hoang Nguyen
(74) *Attorney, Agent, or Firm*—Venable LLP; Eric J. Franklin

(57) ABSTRACT

A heat control system of reheating steam of a power plant, in which method the reheating steam (S3) is superheated in a reheater in a first reheating stage and a second reheating stage. The steam (S6) superheated in the first reheating stage is directed via a heat exchanger (22) to the second reheating stage, and the temperature of the steam decreases in the heat exchanger. In addition, the invention relates to a heat control system and a power plant.

9 Claims, 3 Drawing Sheets

REHEATING STEAM TEMPERATURE CONTROL

CROSS-REFERENCE TO RELATED APPLICATIONS

This application claims priority under 35 USC §119 to Finnish Patent Application No. 20055208 filed on May 4, 2005.

FIELD OF THE INVENTION

The invention relates to a temperature control method for reheating steam of a steam boiler. The invention also relates to a heat control system of reheating steam, as well as a power plant comprising a control system.

BACKGROUND OF THE INVENTION

In order to increase the efficiency of a power plant, especially in large power plants, a reheater is often used. In the reheater the steam that has expanded through a high-pressure turbine is superheated again in medium pressure. From the reheater the heated steam is directed to a medium pressure turbine.

From the point of view of operation it is necessary to be able to control the temperature of the steam to be reheated. For this purpose, various solutions have been developed. One known solution is a spraying cooler. In the solution in question water is sprayed to the reheating steam, in which case the temperature of the steam decreases. The solution is simple, but its problem is that it decreases the total efficiency of the plant. In addition, it is not always possible to use a spraying system.

Because of the problems of the spraying control, other control solutions have also been aimed to be developed. One solution is known from the publication WO 90/08917, which describes such a reheating structure of a fluidized bed boiler, which comprises a two-part reheater and a control structure of steam, by means of which a part of the steam to be reheated can be directed past the first reheater.

SUMMARY OF THE INVENTION

The main purpose of the present invention is to disclose a new solution for controlling the temperature of reheating steam without water spraying.

To attain this purpose, the method according to the invention is primarily characterized in that in the method reheating steam is superheated in a reheater at least in a first reheating stage and a second reheating stage, wherein in the first reheating stage the reheated steam, whose amount can be controlled by control means, is directed via a heat exchanger connected to water flow to the second reheating stage, and in the heat exchanger the temperature of the steam decreases.

The temperature control system of reheating steam according to the invention is primarily characterized in that it comprises at least a first reheater unit and a second reheater unit connected to it for reheating steam, and the system in addition comprises a heat exchanger connected to water flow for decreasing the temperature of the steam superheated by the first reheater unit, which heat exchanger is arranged between the first reheater unit and the second reheater unit in such a manner that at least a part of the steam coming from the first reheater unit can be directed by control means to the heat exchanger before directing to the second reheater unit.

The power plant comprising a control system, in turn, is characterized in that it comprises at least a steam boiler for producing steam from feed water and a reheater, which comprises at least a first reheater unit and a second reheater unit connected to it for reheating steam, wherein the power plant in addition comprises a heat exchanger connected to water flow for decreasing the temperature of the steam superheated by the first reheater unit, which heat exchanger is arranged between the first reheater unit and the second reheater unit in such a manner that at least a part of the steam coming from the first reheater unit can be directed with control means to the heat exchanger before directing to the second reheater unit.

In the temperature control method of reheating steam in a steam power plant the reheating steam is superheated in at least two stages. The reheating steam is directed to a reheater, which comprises at least a first reheater unit and a second reheater unit. From the first reheater unit steam is directed to the second reheater unit via a heat exchanger. In the heat exchanger the temperature of the steam superheated in the first stage decreases before the second superheating stage.

A corresponding temperature control system comprises at least a first reheater unit and a second reheater unit connected to it in order to superheat steam in at least two superheating stages. In addition, the system comprises a heat exchanger for decreasing the temperature of the steam, which heat exchanger is arranged between the first reheater unit and the second reheater unit in such a manner that at least a part of the steam coming from the first reheater unit can be directed to the heat exchanger before being directed to the second reheater unit.

In an embodiment of the invention the steam coming from the first reheater unit is divided into a first and a second part, of which the first part of the steam is directed via the heat exchanger to the second reheater unit, and the second part of the steam is directed past the heat exchanger to the second reheater unit. The heat delivery surfaces connected to the steam of the heat exchanger are advantageous to be arranged in a temperature higher than the saturation temperature of pressurized steam.

In another embodiment of the invention the heat energy of steam in the heat exchanger is transferred to the preheated feed water of the power plant. The preheating of feed water typically takes place in a preheater, i.e. an economizer. By using water preheated in the economizer in the heat exchanger, the temperature of which water is higher than the temperature corresponding to the saturated pressure of steam, the steam does not condense on the heat delivery surface.

The solution according to the invention enables temperature control of the steam being reheated without spraying control. However, it is possible to place the spraying system in connection with the system, in which case it can be used when necessary in possible breakdowns.

An advantageous embodiment of the invention enables a wide temperature control area of reheating. The control area is affected by, inter alia, the dimensioning of the heat exchanger.

Another embodiment, in turn, enables decreasing the preheater (i.e. economizer) of feed water. The economizer is a high-pressure structure, in which case decreasing it often has an advantageous effect on the required work and construction expenses.

DESCRIPTION OF THE DRAWINGS

In the following, the invention will be described in more detail with reference to the appended principle drawings, in which.

DETAILED DESCRIPTION OF THE INVENTION

Figure 1:
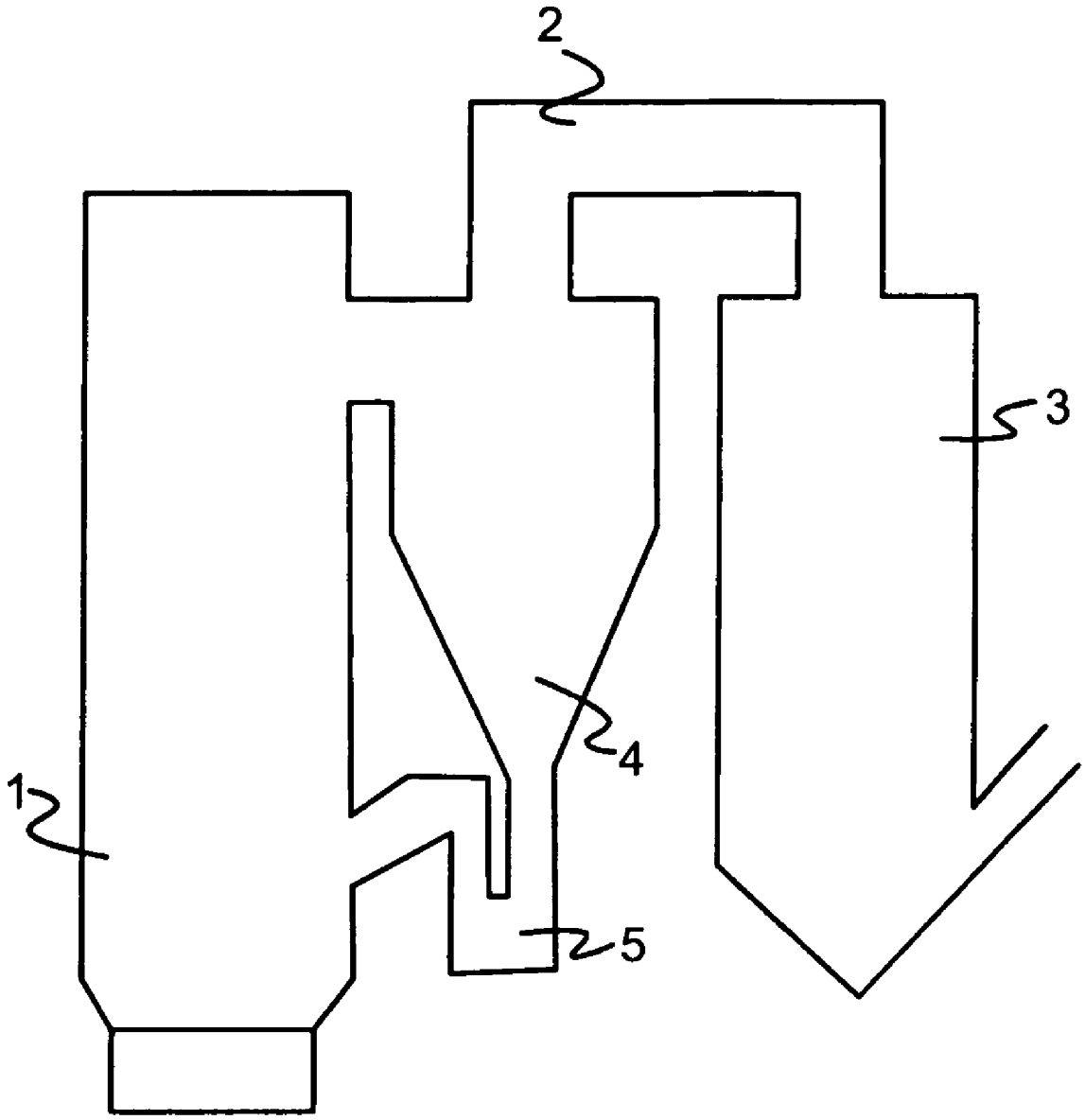
FIG. 1 shows a vertical cross-section of a steam boiler illustrating the typical locations of heat delivery surfaces

FIG. 1 shows a simplified part of a steam power plant. The power plant comprises a combustion chamber 1, where the combustion process of fuel primarily takes place. Typically there are structures suitable for evaporating preheated water in the walls of the combustion chamber, for example, a so-called boiler or drum. There is a channel 2 as an extension of the combustion chamber, and typically superheaters in the upper part of the combustion chamber and/or the channel. Feed water preheaters, i.e. economizers are often located in the later stages 3 of the channel 2, as well as combustion air preheaters, i.e. so-called luvo. In addition, the power plant comprises steam turbine structures, which are not shown in the figure. In addition, different types of power plants have their own kinds of structures, such as, for example, fluidizing structures in a fluidized bed boiler and a cyclone 4 in a circulating fluidized bed boiler. The figure also shows a sand seal 5 of a circulating fluidized bed boiler, where superheaters can be located in some applications. On the basis of the description of the invention, the solution according to the invention can be applied with necessary changes to different power plant and boiler structures on the basis of the information of a person skilled in the art.

Figure 2:
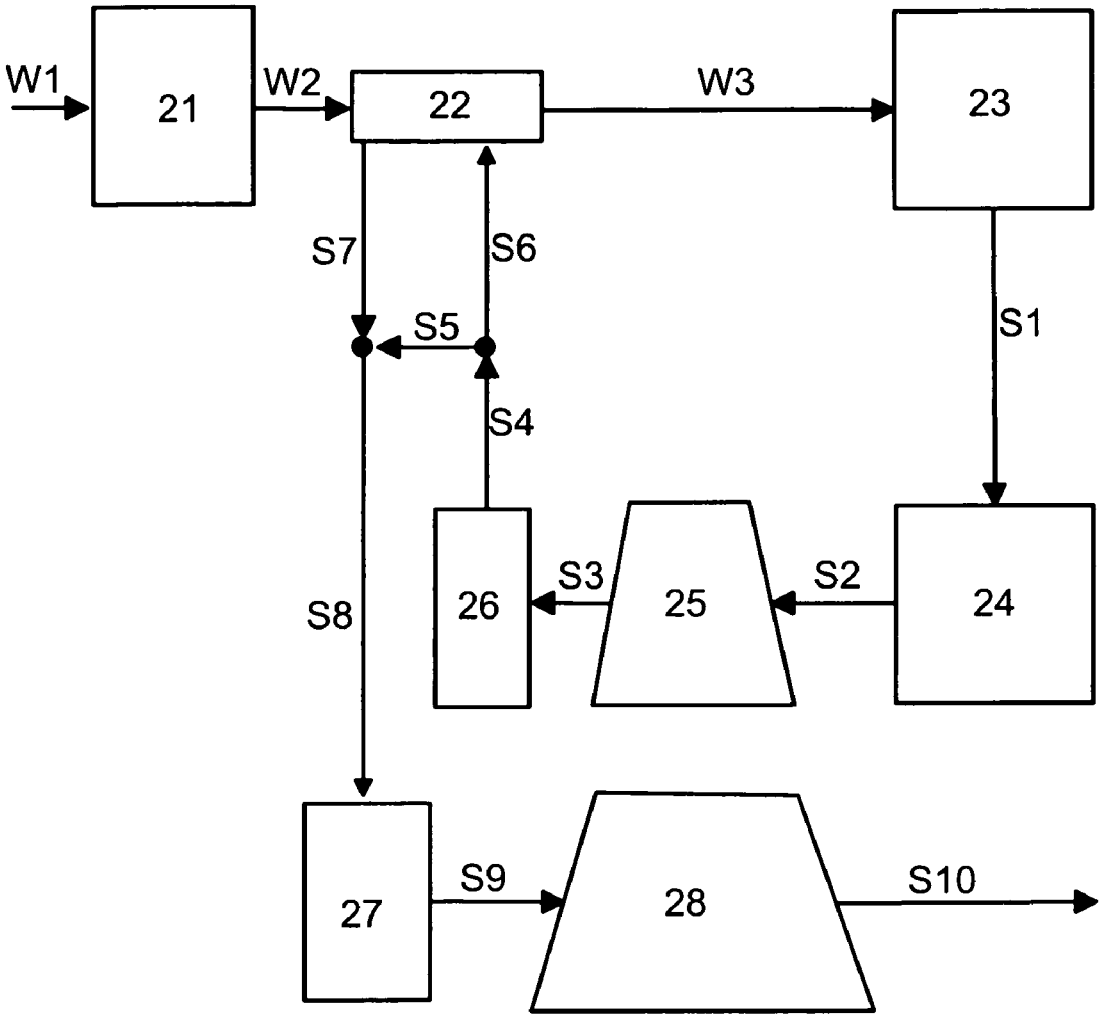
FIG. 2 shows water and steam circuits according to an embodiment of the invention

FIG. 2, in turn, shows in principle the water and steam circuits according to an embodiment. The feed water W1 of the boiler is first directed to a preheater 21 of feed water, i.e. the economizer. Form the economizer 21 the water W2 is directed via a heat exchanger unit 22 to a drum 23 of the boiler. From the drum 23, saturated steam S1 is provided, whose temperature is further increased by superheaters 24. The superheated steam S2 is fed to a turbine 25, wherein the heat energy is converted into mechanical energy. Typically, the so-called main steam S2 is fed to the high-pressure turbine 25, where the pressure of the steam decreases. From the high-pressure turbine 25 the medium-pressure steam S3 is directed to reheating. Reheating is performed by the reheating solution described later. In the reheaters 26, 27 the temperature of the medium-pressure steam S3 rises. The superheated medium-pressure steam S9 is directed to the medium-pressure turbine 28. Typically the steam S10 from the intermediate pressure turbine is directed yet to a low-pressure turbine before directing it to a condenser, which structures are not shown in the figure.

As can be seen from FIG. 2, the reheater structure according to the invention comprises at least two superheating stages, which are performed in two reheater units 26, 27 in the example. There is a heat exchanger unit 22 between the reheater units 26, 27. Steam S4 coming from the first reheating stage, i.e. the first reheater unit 26 is, when necessary, divided into two parts, of which the first part of steam S6 is directed via the heat exchanger unit 22 to the second reheater 27, and the second part of steam S5 is directed past the heat exchanger unit to the second reheating stage. In an embodiment the steam S7 coming from the heat exchanger unit 22 is combined with the steam S5 passing the heat exchanger unit before the second reheating stage. The combined steam flow S8 is brought to the second reheater unit 27 to the second reheating stage. The heat exchanger unit 22 is advantageously connected to the water circuit coming from the economizer 21. Thus, the heat exchange takes place between the steam S6 coming from the first reheating stage and the water W2 coming from the economizer 21, in which case the temperature of the water W3 exiting the heat exchanger unit rises and the temperature of the steam S7 exiting the heat exchange unit decreases.

Figure 3:
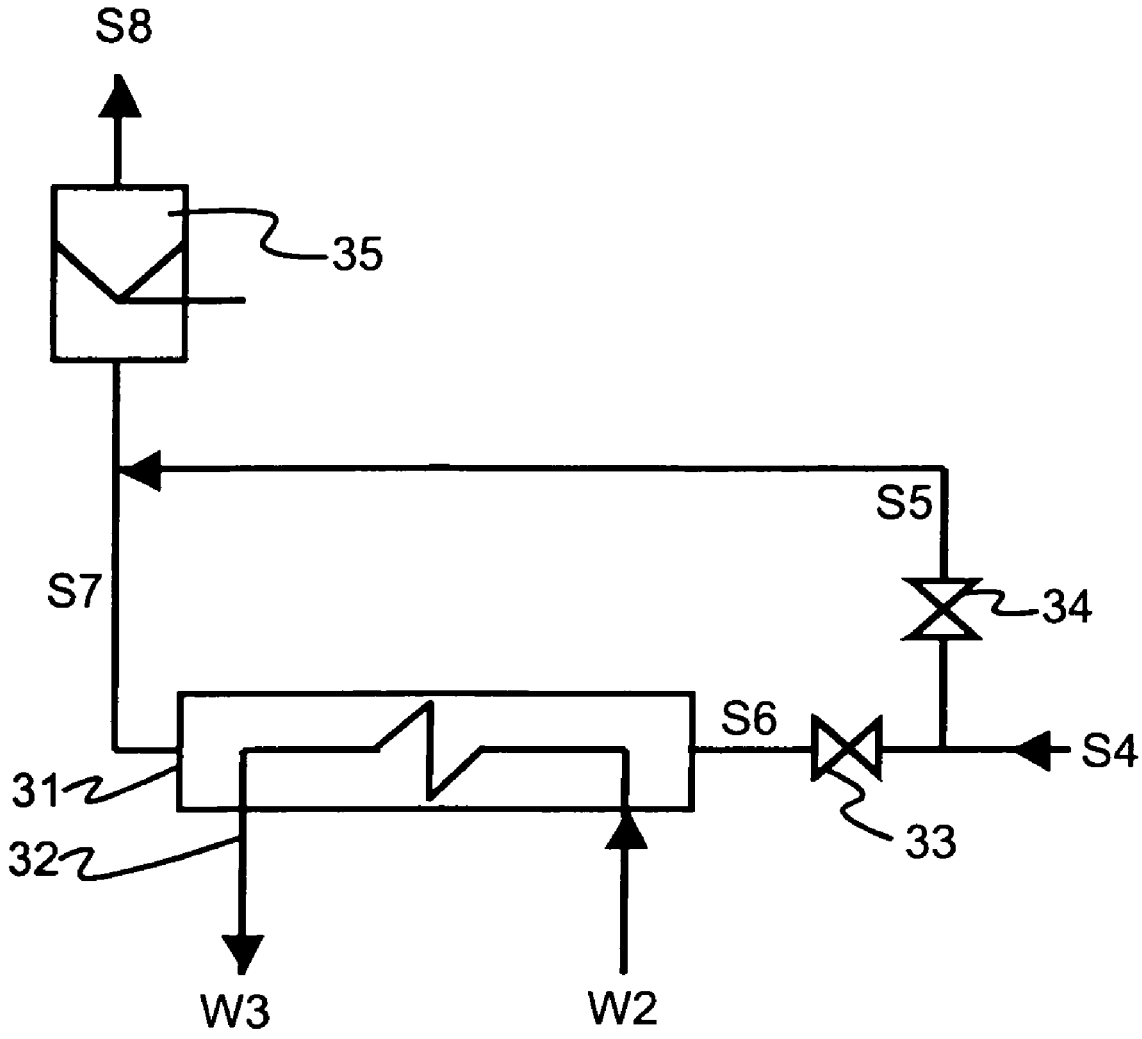
FIG. 3 shows an embodiment of a heat control system according to the invention For the sake of clarity, the figures only show the details necessary for understanding the invention. The structures and details that are not necessary for understanding the invention, but are obvious for anyone skilled in the art, have been omitted from the figures in order to emphasize the characteristics of the invention.

FIG. 3 shows an embodiment of the temperature control system according to the invention. In the example a steam flow S6 to be cooled and a feed water flow W2 are arranged to the heat exchanger unit 22. The cooled steam S7 and warmed water W3, in turn, go forward from the heat exchanger unit 22.

There are first dampers and valves 33 and second dampers and valves 34 in the temperature control system shown in FIG. 3, by means of which the amount of steam S6 flowing through the heat exchanger unit 22 and the steam S5 flowing past the heat exchanger unit can be controlled. Various suitable structures can be used as dampers and valves 33, 34, such as, for example different valve and hatch structures.

The figure also shows a water spraying apparatus 35, which is advantageous to arrange in the heat control system in case of breakdowns. Thus, in exceptional situations it is possible to spray water among the steam S8 in order to decrease the temperature of the steam.

Typically the temperature difference between the steam S6 and the feed water W2 in the heat exchanger unit is within the range of 100 to 200° C. The incoming feed water W2 warms in a heat exchanger unit 22 approximately 10° C. before the water W3 leaves the heat exchanger unit. The heat transfer is affected, inter alia, by the dimensioning of the heat exchanger unit 22, the materials used, and flow rates. The warming of the feed water W2 coming from the economizer 21 in the heat exchanger unit 22 decreases the desired temperature of the water exiting the economizer in an application. Thus, the economizer 21 can be dimensioned smaller. Because the economizer 21 is a high-pressure structure, the decrease in the structure has a positive effect on the expenses of the economizer.

In the previous examples the dampers and valves 33, 34 are placed before the heat exchanger unit 22 seen in the flow direction of the steam, but in some applications the dampers and valves can be placed after the heat exchanger unit.

The amount of steam S6 directed to the heat exchanger unit 22 typically depends on the load of the power plant. In one case with a full load approximately 50% of the reheating steam S4 is directed via the heat exchanger unit 22. With a smaller partial load all of the reheating steam S4 goes past the heat exchanger unit 22 (steam route S5).

The control area of the control system is affected by the dimensioning of the system. The size of the required control area is affected, inter alia, by the manner of usage of the power plant and the variability of the load. The control solution according to the invention is applicable for use in different steam power plants, such as, for example, bubbling fluidized bed boilers and circulating fluidized bed boilers.

The control solution according to the invention does not depend on the number of reheater units 26, 27 nor their placement. All or a part of the reheater units 26, 27 can be located, for example, in connection with the combustion chamber 1, above 2 the combustion chamber, in a channel 3 following the combustion chamber, or somewhere else. The heat control system can also comprise more heat exchanger units 22 described above, which may be connected in series or in parallel. By changing their connection, it is possible to affect the amount of steam S6, S7 traveling via them and thus the temperature of the steam S7, S9 to be reheated.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the invention may be freely varied within the scope of the inventive features presented in the claims hereinbelow.

The invention claimed is:

1. A method for controlling heat of reheating steam in a steam power plant, the method comprising:

superheating reheating steam in a reheater at least in a first reheating stage and a second reheating stage;

directing the reheating steam from the first reheating stage through a first circuit of a heat exchanger to the second reheating stage; and circulating water through a second circuit of the heat exchanger such that heat flows from the reheating steam to the water thereby decreasing a temperature of the reheating steam.

2. The method according to claim 1, further comprising:

dividing the reheating steam superheated in the first reheating stage into a first part and a second part;

directing the first part of the divided reheating steam via the heat exchanger to the second reheating stage; and directing the second part of the divided reheating steam past the heat exchanger to the second reheating stage.

3. The method according to claim 1, further comprising:

transferring heat energy of the reheating steam in the heat exchanger to a preheated feed water of the power plant.

4. A heat control system for reheating steam, the system comprising:

a first reheater unit for reheating steam;

a heat exchanger operatively connected to the first reheater, the heat exchanger comprising a first circuit for receiving at least a portion of steam reheated in the first reheater unit and a second circuit through which water is circulated, such that heat flows from the reheated steam to the water thereby decreasing a temperature of the reheated steam;

a second reheater unit for reheating steam operatively connected to the heat exchanger for receiving the portion of the reheated steam; and a control configured to control from of steam among the first reheater unit, the heat exchanger, and the second reheater unit.

5. The heat control system according to claim 4, further comprising:

a heat exchanger bypass connected between the first reheater unit and the second reheater unit, wherein a first part of steam can be directed from the first reheater unit to the second reheater unit via the heat exchanger and a second part of steam can be directed from the first reheater unit to the second reheater unit via the bypass.

6. The heat control system according to claim 4, wherein the heat exchanger is connected to a feed water and an output of steam of the first reheater unit, and wherein heat energy of the steam is transferred to preheated feed water of a power plant.

7. A power plant, comprising:

a steam boiler for producing steam from feed water;

a reheater for reheating steam, the reheater comprising a first reheater unit and a second reheater unit;

a heat exchanger operatively connected between the first reheater unit and the second reheater unit, the heat exchanger comprising a first circuit for receiving at least a portion of steam reheated in the first reheater unit and a second circuit through which water is circulated, such that heat flows from the steam reheated in by the first reheater unit to the water thereby decreasing a temperature of the reheated steam;

a control configured to control from of steam among the first reheater unit, the heat exchanger, and the second reheater unit.

8. The power plant according to claim 7, further comprising:

a heat exchanger bypass connected between the first reheater unit and the second reheater unit, wherein a first part of steam can be directed from the first reheater unit to the second reheater unit via the heat exchanger and a second part of steam can be directed from the first reheater unit to the second reheater unit via the bypass.

9. The power plant according to claim 7, wherein the heat exchanger is connected to the feed water and an output of steam of the first reheater unit, and wherein the heat energy of the steam is transferred to preheated feed water of the power plant.

* * * * *